US010923041B2

(12) United States Patent
Yuan et al.

(10) Patent No.: US 10,923,041 B2
(45) Date of Patent: Feb. 16, 2021

(54) DETECTION METHOD AND DETECTION DEVICE FOR ARRAY SUBSTRATE DRIVING CIRCUIT

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Zhidong Yuan, Beijing (CN); Yongqian Li, Beijing (CN)

(73) Assignees: Hefei Xinsheng Optoelectronics Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 125 days.

(21) Appl. No.: 16/341,626

(22) PCT Filed: Oct. 31, 2018

(86) PCT No.: PCT/CN2018/113102
§ 371 (c)(1),
(2) Date: Apr. 12, 2019

(87) PCT Pub. No.: WO2019/085952
PCT Pub. Date: May 9, 2019

(65) Prior Publication Data

US 2020/0394965 A1 Dec. 17, 2020

(30) Foreign Application Priority Data

Nov. 6, 2017 (CN) ..... 201711078250.7

(51) Int. Cl.
*G09G 3/3291* (2016.01)
*G09G 3/00* (2006.01)

(52) U.S. Cl.
CPC ..... *G09G 3/3291* (2013.01); *G09G 3/006* (2013.01); *G09G 2330/12* (2013.01)

(58) Field of Classification Search
CPC ... G09G 3/3291; G09G 3/006; G09G 2330/12
See application file for complete search history.

(56) References Cited

U.S. PATENT DOCUMENTS 9,230,474 B2 1/2016 Jin et al.
9,378,678 B1 * 6/2016 Lee ..... G09G 3/2003
(Continued)

FOREIGN PATENT DOCUMENTS

CN 1774734 A 5/2006
CN 1804647 A 7/2006
(Continued)

OTHER PUBLICATIONS

First Office Action for CN Appl. No. 201711078250.7, dated Feb. 27, 2019.
(Continued)

*Primary Examiner* — Dmitriy Bolotin
(74) *Attorney, Agent, or Firm* — The Webb Law Firm

(57) ABSTRACT

The present disclosure provides a detection method and a detection device for an array substrate driving circuit. In the detection method, in an all-on stage, a first supply voltage signal is input to a power terminal, a first data voltage signal is input to a data input terminal, a first sensing voltage signal is input to a sensing voltage terminal, a first gate-on signal is input to a first gate terminal, and a second gate-on signal is input to a second gate terminal. In a data voltage changing stage, the first data voltage signal is changed to a second data voltage signal. In a measurement stage, a voltage at a first electrode terminal of the light emitting device is measured,
(Continued)

and the measured voltage is compared with a theoretical voltage to determine whether the array substrate driving circuit is normal.

20 Claims, 7 Drawing Sheets

(56) References Cited

U.S. PATENT DOCUMENTS

| | | | | |
|---|---|---|---|---|
| 10,593,242 | B2 * | 3/2020 | Zhu | H01L 27/3276 |
| 10,706,788 | B2 * | 7/2020 | Chen | G09G 3/3258 |
| 2014/0333852 | A1 | 11/2014 | Ishikawa et al. | |
| 2015/0001504 | A1 * | 1/2015 | Kim | H01L 27/32 257/40 |
| 2015/0179102 | A1 * | 6/2015 | Kim | G09G 3/3291 345/77 |
| 2015/0187268 | A1 * | 7/2015 | Tani | G09G 3/3233 345/77 |
| 2016/0086544 | A1 * | 3/2016 | Park | G09G 3/3266 345/690 |
| 2016/0125811 | A1 * | 5/2016 | Park | G09G 3/3258 345/694 |
| 2018/0005556 | A1 * | 1/2018 | Xu | G09G 3/3225 |
| 2018/0018752 | A1 * | 1/2018 | Kurokawa | G06F 1/3218 |
| 2018/0061293 | A1 * | 3/2018 | Park | G09G 3/006 |
| 2018/0061296 | A1 * | 3/2018 | Shim | G09G 3/3233 |
| 2018/0061316 | A1 * | 3/2018 | Shin | G09G 3/3266 |
| 2019/0122616 | A1 * | 4/2019 | Lee | G09G 3/3233 |
| 2019/0304374 | A1 * | 10/2019 | Wang | H01L 29/78648 |
| 2020/0074932 | A1 * | 3/2020 | Park | G09G 3/3291 |

FOREIGN PATENT DOCUMENTS

| | | | |
|---|---|---|---|
| CN | 106128342 | A | 11/2016 |
| CN | 106409198 | A | 2/2017 |
| CN | 107610629 | A | 1/2018 |

OTHER PUBLICATIONS

International Search Report and Written Opinion for International Appl. No. PCT/CN2018/113102, dated Oct. 16, 2018.

* cited by examiner

DETECTION METHOD AND DETECTION DEVICE FOR ARRAY SUBSTRATE DRIVING CIRCUIT

CROSS-REFERENCE TO RELATED APPLICATIONS

The present application is a U.S. National Stage Application under 35 U.S.C. § 371 of International Patent Application No. PCT/CN2018/113102, filed on Oct. 31, 2018, which claims priority to China Patent Application No. 201711078250.7, filed on Nov. 6, 2017, the disclosure of both of which are incorporated by reference herein in entirety.

TECHNICAL FIELD

The present disclosure relates to a detection method and a detection device for an array substrate driving circuit.

BACKGROUND

In the display industry, OLED (Organic Light Emitting Diode) which has advantages such as high contrast and high color gamut, serves as the mainstream trend of the display panel development in the future development. For example, the OLED display is AMOLED (Active Matrix Organic Light Emitting Diode) display. In addition to the above advantages, the AMOLED display has advantages such as wide viewing angle and fast response speed. However, the OLED product has very strict requirements on the back plate on which the TFT (Thin Film Transistor) is formed.

SUMMARY

According to one aspect of embodiments of the present disclosure, a detection method for an array substrate driving circuit is provided. The array substrate driving circuit comprises a pixel driving circuit comprising a storage capacitor, a first switching transistor, a second switching transistor, and a third switching transistor, wherein a gate of the first switching transistor is electrically connected to a first gate terminal, a first electrode of the first switching transistor is electrically connected to a data input terminal, a second electrode of the first switching transistor is electrically connected to a first terminal of the storage capacitor, a gate of the second switching transistor is electrically connected to a second gate terminal, a first electrode of the second switching transistor is electrically connected to a sensing voltage terminal, a second electrode of the second switching transistor is electrically connected to a second terminal of the storage capacitor, the second terminal of the storage capacitor is electrically connected to a first electrode terminal of a light emitting device, and a gate of the third switching transistor is electrically connected to the first terminal of the storage capacitor, a first electrode of the third switching transistor is electrically connected to the first electrode terminal of the light emitting device, and a second electrode of the third switching transistor is electrically connected to a power terminal; the detection method comprising: in an all-on stage, inputting a first supply voltage signal to the power terminal, inputting a first data voltage signal to the data input terminal, inputting a first sensing voltage signal to the sensing voltage terminal, inputting a first gate-on signal to the first gate terminal, and inputting a second gate-on signal to the second gate terminal, such that the first switching transistor, the second switching transistor, and the third switching transistor are all turned on; in a data voltage changing stage after an end of the all-on stage, changing the first data voltage signal to a second data voltage signal, wherein the second data voltage signal is stored at the first terminal of the storage capacitor; and in a measurement stage after the data voltage changing stage, measuring a voltage at the first electrode terminal of the light emitting device, and comparing the measured voltage with a theoretical voltage to determine whether the array substrate driving circuit is normal.

In some embodiments, the array substrate driving circuit is determined to be normal in a case where a difference between the measured voltage and the theoretical voltage is within a predetermined range; and the array substrate driving circuit is determined to be abnormal in a case where the difference between the measured voltage and the theoretical voltage is out of the predetermined range.

In some embodiments, before the measurement stage, the detection method further comprises: in a supply voltage changing stage after an end of the data voltage changing stage, changing the first supply voltage signal to a second supply voltage signal.

In some embodiments, before the measurement stage, the detection method further comprises: in a gate signal changing stage after an end of the supply voltage changing stage, changing the first gate-on signal to a first gate-off signal, such that the first switching transistor is turned off, and changing the second gate-on signal to a second gate-off signal, such that the second switching transistor is turned off, wherein an on-resistance of the third switching transistor under an effect of the second supply voltage signal and the second data voltage signal stored at the first terminal of the storage capacitor is greater than an on-resistance of the third switching transistor under an effect of the first data voltage signal in the all-on stage.

In some embodiments, the first switching transistor, the second switching transistor, and the third switching transistor are all NMOS transistors; wherein a level of the second data voltage signal is higher than a level of the second supply voltage signal.

In some embodiments, a difference $V_{Data_Vdd}$ between the level of the second data voltage signal and the level of the second supply voltage signal is in a range of $0V<V_{Data_Vdd}\leq 5V$.

In some embodiments, the first supply voltage signal, the first data voltage signal, the first sensing voltage signal, the first gate-on signal, and the second gate-on signal all have a level higher than 0V; and the second data voltage signal, the second supply voltage signal, the first gate-off signal, and the second gate-off signal all have a level lower than 0V.

In some embodiments, the first switching transistor, the second switching transistor, and the third switching transistor are all PMOS transistors; wherein a level of the second data voltage signal is lower than a level of the second supply voltage signal.

In some embodiments, a difference $V_{Data'_Vdd'}$ between the level of the second data voltage signal and the level of the second supply voltage signal is in a range of $-5V\leq V_{Data'_Vdd'}<0V$.

In some embodiments, the first supply voltage signal, the first data voltage signal, the first sensing voltage signal, the first gate-on signal, and the second gate-on signal all have a level lower than 0V; and the second data voltage signal, the second supply voltage signal, the first gate-off signal, and the second gate-off signal all have a level higher than 0V.

In some embodiments, within the measurement stage, before measuring the voltage at the first electrode terminal of the light emitting device, the detection method further comprises: changing the first sensing voltage signal to a second sensing voltage signal.

In some embodiments, the second sensing voltage signal has a level lower than 0V in a case where the first switching transistor, the second switching transistor, and the third switching transistor are all NMOS transistors.

In some embodiments, the second sensing voltage signal has a level higher than 0V in a case where the first switching transistor, the second switching transistor, and the third switching transistor are all PMOS transistors.

In some embodiments, before the all-on stage, the detection method further comprises: in an initial stage, inputting the second supply voltage signal to the power terminal, inputting the second data voltage signal to the data input terminal, inputting the second sensing voltage signal to the sensing voltage terminal, inputting the first gate-off signal to the first gate terminal, and inputting the second gate-off signal to the second gate terminal, such that the first switching transistor, the second switching transistor, and the third switching transistor are all turned off.

In some embodiments, before the all-on stage, the detection method further comprises: in a second stage after an end of the initial stage, changing the second supply voltage signal to the first supply voltage signal.

In some embodiments, before the all-on stage, the detection method further comprises: in a third stage after an end of the second stage, changing the second data voltage signal to the first data voltage signal and changing the second sensing voltage signal to the first sensing voltage signal.

In some embodiments, the step of inputting the first gate-on signal and the second gate-on signal in the all-on stage comprises: changing the first gate-off signal to the first gate-on signal, and changing the second gate-off signal to the second gate-on signal.

According to another aspect of embodiments of the present disclosure, a detection device for an array substrate driving circuit is provided. The array substrate driving circuit comprises a pixel driving circuit comprising a storage capacitor, a first switching transistor, a second switching transistor, and a third switching transistor, wherein a gate of the first switching transistor is electrically connected to a first gate terminal, a first electrode of the first switching transistor is electrically connected to a data input terminal, a second electrode of the first switching transistor is electrically connected to a first terminal of the storage capacitor, a gate of the second switching transistor is electrically connected to a second gate terminal, a first electrode of the second switching transistor is electrically connected to a sensing voltage terminal, a second electrode of the second switching transistor is electrically connected to a second terminal of the storage capacitor, the second terminal of the storage capacitor is electrically connected to a first electrode terminal of a light emitting device, and a gate of the third switching transistor is electrically connected to the first terminal of the storage capacitor, a first electrode of the third switching transistor is electrically connected to the first electrode terminal of the light emitting device, and a second electrode of the third switching transistor is electrically connected to a power terminal; the detection device comprising: a signal input circuit configured to, in an all-on stage, input a first supply voltage signal to the power terminal, input a first data voltage signal to the data input terminal, input a first sensing voltage signal to the sensing voltage terminal, input a first gate-on signal to the first gate terminal, and input a second gate-on signal to the second gate terminal, such that the first switching transistor, the second switching transistor, and the third switching transistor are all turned on; and change the first data voltage signal to a second data voltage signal in a data voltage changing stage after an end of the all-on stage, wherein the second data voltage signal is stored at the first terminal of the storage capacitor; a signal readout circuit configured to read a voltage at the first electrode terminal of the light emitting device in a measurement stage after the data voltage changing stage; and a comparator configured to compare the read voltage with a theoretical voltage to determine whether the array substrate driving circuit is normal.

In some embodiments, the comparator is configured to determine the array substrate driving circuit to be normal in a case where a difference between the read voltage and the theoretical voltage is within a predetermined range; and determine the array substrate driving circuit to be abnormal in the case that the difference between the read voltage and the theoretical voltage is out of the predetermined range.

In some embodiments, the signal input circuit is further configured to change the first supply voltage signal to a second supply voltage signal in a supply voltage changing stage after an end of the data voltage changing stage and before the measurement stage.

In some embodiments, the signal input circuit is further configured to, in a gate signal changing stage after an end of the supply voltage changing stage and before the measurement stage, change the first gate-on signal to a first gate-off signal such that the first switching transistor is turned off, and change the second gate-on signal to a second gate-off signal such that the second switching transistor is turned off, wherein an on-resistance of the third switching transistor under an effect of the second supply voltage signal and the second data voltage signal stored at the first terminal of the storage capacitor is greater than an on-resistance of the third switching transistor under an effect of the first data voltage signal in the all-on stage.

In some embodiments, the signal input circuit is further configured to change the first sensing voltage signal to a second sensing voltage signal within the measurement stage; wherein the second sensing voltage signal has a level lower than 0V in a case where the first switching transistor, the second switching transistor, and the third switching transistor are all NMOS transistors; the second sensing voltage signal has a level higher than 0V in a case where the first switching transistor, the second switching transistor, and the third switching transistor are all PMOS transistors.

Other features and advantages of the present disclosure will become apparent from the following detailed description of exemplary embodiments of the present disclosure with reference to the accompanying drawings.

BRIEF DESCRIPTION OF THE DRAWINGS

The accompanying drawings, which constitute part of this specification, illustrate exemplary embodiments of the present disclosure and, together with this specification, serve to explain the principles of the present disclosure.

The present disclosure may be more clearly understood from the following detailed description with reference to the accompanying drawings, in which.

Figure 1:
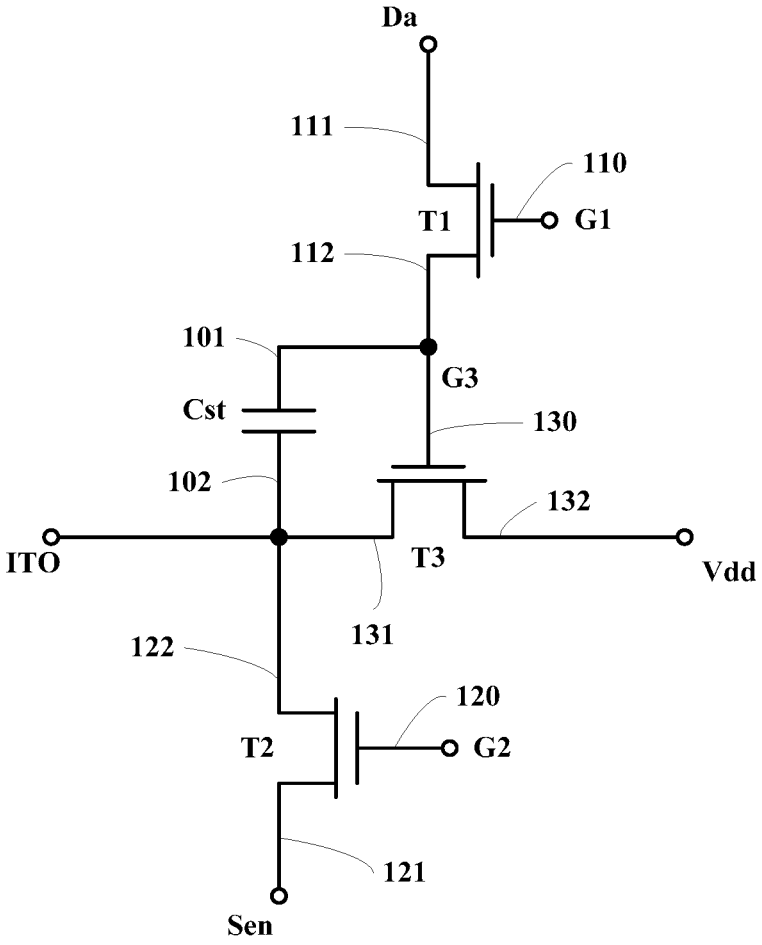
FIG. 1 is a circuit connection diagram schematically showing a pixel driving circuit of an embodiment.

It should be understood that the dimensions of the various parts shown in the accompanying drawings are not drawn according to the actual scale. In addition, the same or similar reference signs are used to denote the same or similar components.

DETAILED DESCRIPTION

Various exemplary embodiments of the present disclosure will now be described in detail with reference to the accompanying drawings. The description of the exemplary embodiments is merely illustrative and is in no way intended as a limitation to the present disclosure, its application or use. The present disclosure may be implemented in many different forms, which are not limited to the embodiments described herein. These embodiments are provided to make the present disclosure thorough and complete, and fully convey the scope of the present disclosure to those skilled in the art. It should be noticed that: relative arrangement of components and steps, material composition, numerical expressions, and numerical values set forth in these embodiments, unless specifically stated otherwise, should be explained as merely illustrative, and not as a limitation.

The use of the terms "first", "second" and similar words in the present disclosure do not denote any order, quantity or importance, but are merely used to distinguish between different parts. A word such as "comprise", "include" means that the element before the word covers the element(s) listed after the word without excluding the possibility of also covering other elements. The terms "up", "down", "left", "right", or the like are used only to represent a relative positional relationship, and the relative positional relationship may be changed correspondingly if the absolute position of the described object changes.

In the present disclosure, when it is described that a particular device is located between the first device and the second device, there may be an intermediate device between the particular device and the first device or the second device, and alternatively, there may be no intermediate device. When it is described that a particular device is electrically connected to other devices, the particular device may be directly electrically connected to said other devices without an intermediate device, and alternatively, may not be directly electrically connected to said other devices but with an intermediate device.

Unless otherwise defined, all terms (comprising technical and scientific terms) used herein have the same meanings as the meanings commonly understood by one of ordinary skill in the art to which the present disclosure belongs. It should also be understood that terms as defined in general dictionaries, unless explicitly defined herein, should be interpreted as having meanings that are consistent with their meanings in the context of the relevant art, and not to be interpreted in an idealized or extremely formalized sense.

Techniques, methods, and apparatus known to those of ordinary skill in the relevant art may not be discussed in detail, but where appropriate, these techniques, methods, and apparatuses should be considered as part of this specification.

The inventors of the present disclosure have realized that, in the related art, the pixel driving circuit inside the OLED panel has very complicated lines and many types of defective circuits. For example, the lines of the pixel driving circuit may be subject to a circumstance of short circuit or broken circuit (or referred thereto as open circuit), resulting in an abnormal pixel driving circuit. This will cause problems such as reduced yield of OLED products and increased back-end finished product cost of the products.

In view of this, the embodiments of the present disclosure provide a detection method for an array substrate driving circuit to effectuate detecting whether the array substrate driving circuit is normal.

In the embodiments of the present disclosure, the array substrate driving circuit comprise a pixel driving circuit. For example, the array substrate driving circuit may comprise a plurality of pixel driving circuits and lines connecting these pixel driving circuits. Hereinafter, taking FIG. 1 as an example, a circuit connection diagram of a pixel driving circuit according to some embodiments of the present disclosure will be described.

FIG. 1 is a circuit connection diagram schematically showing a pixel driving circuit of an embodiment. As shown in FIG. 1, the pixel driving circuit may comprise a storage capacitor Cst, a first switching transistor T1, a second switching transistor T2, and a third switching transistor T3.

A gate 110 of the first switching transistor T1 is electrically connected to a first gate terminal G1. A first electrode 111 of the first switching transistor T1 is electrically connected to a data input terminal Da. A second electrode 112 of the first switching transistor T1 is electrically connected to a first terminal 101 of the storage capacitor Cst.

A gate 120 of the second switching transistor T2 is electrically connected to a second gate terminal G2. A first electrode 121 of the second switching transistor T2 is electrically connected to a sensing voltage terminal Sen. A second electrode 122 of the second switching transistor T2 is electrically connected to a second terminal 102 of the storage capacitor Cst. The second terminal 102 of the storage capacitor Cst is also electrically connected to a first electrode terminal (e.g., anode terminal) ITO of a light emitting device (not shown in FIG. 1).

A gate 130 of the third switching transistor T3 is electrically connected to the first terminal 101 of the storage capacitor Cst. A first electrode 131 of the third switching transistor T3 is electrically connected to the first electrode terminal ITO of the light emitting device. A second electrode 132 of the third switching transistor T3 is electrically connected to a power terminal Vdd. As shown in FIG. 1, the first terminal 101 of the storage capacitor Cst, the second electrode 112 of the first switching transistor T1, and the gate 130 of the third switching transistor T3 are connected to the same node G3.

In some embodiments, as shown in FIG. 1, all of the first switching transistor T1, the second switching transistor T2, and the third switching transistor T3 may be NMOS (N-channel Metal Oxide Semiconductor) transistors.

Figure 2A:
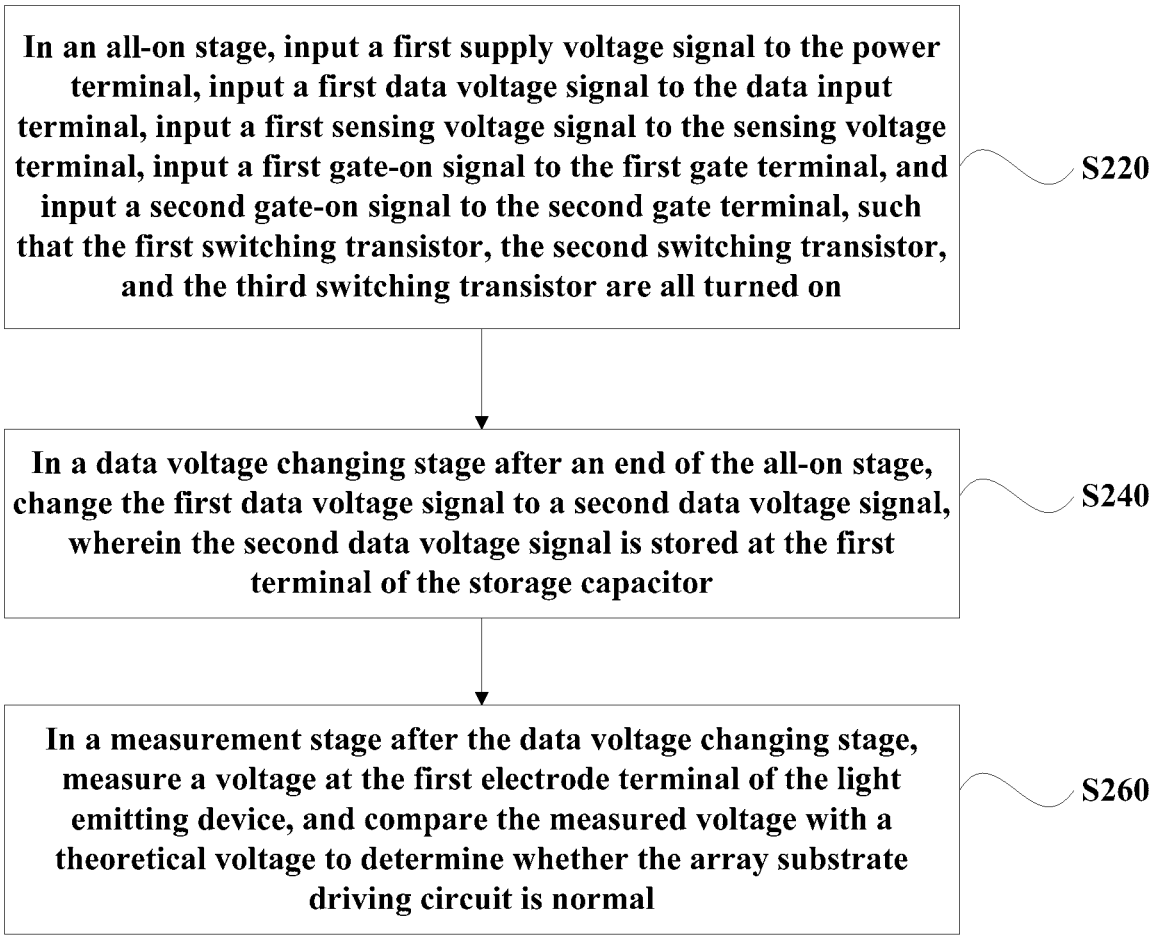
FIG. 2A is a flow chart showing a detection method for an array substrate driving circuit according to an embodiment of the present disclosure.

FIG. 2A is a flow chart showing a detection method for an array substrate driving circuit according to an embodiment of the present disclosure. As shown in FIG. 2A, the detection method comprises steps S220 to S260.

At step S220, in an all-on stage, a first supply voltage signal is input to the power terminal, a first data voltage signal is input to the data input terminal, a first sensing voltage signal is input to the sensing voltage terminal, a first gate-on signal is input to the first gate terminal, and a second gate-on signal is input to the second gate terminal, such that the first switching transistor, the second switching transistor, and the third switching transistor are all turned on.

At step S240, in a data voltage changing stage after an end of the all-on stage, the first data voltage signal is changed to a second data voltage signal, wherein the second data voltage signal is stored at the first terminal of the storage capacitor.

At step S260, in a measurement stage after the data voltage changing stage, a voltage at the first electrode terminal of the light emitting device is measured, and the measured voltage is compared with a theoretical voltage to determine whether the array substrate driving circuit is normal. That is, in this embodiment, the voltage at the first electrode terminal of the light emitting device is directly measured after the data voltage changing stage and the measured voltage is compared with the theoretical voltage.

Hitherto, a detection method according to some embodiments of the present disclosure is provided. In the detection method, in the all-on stage, the first supply voltage signal is input to the power terminal, the first data voltage signal is input to the data input terminal, the first sensing voltage signal is input to the sensing voltage terminal, the first gate-on signal is input to the first gate terminal, and the second gate-on signal is input to the second gate terminal, such that the first switching transistor, the second switching transistor, and the third switching transistor are all turned on. Next, in the data voltage changing stage, the first data voltage signal is changed to the second data voltage signal. Next, in the measurement stage, the voltage at the first electrode terminal of the light emitting device is measured, and the measured voltage is compared with a theoretical voltage to determine whether the array substrate driving circuit is normal, so that the detection of the array substrate driving circuit is realized. For example, the above-described detection method may realize the detection of a data line for transmitting a data voltage signal.

Figure 2B:
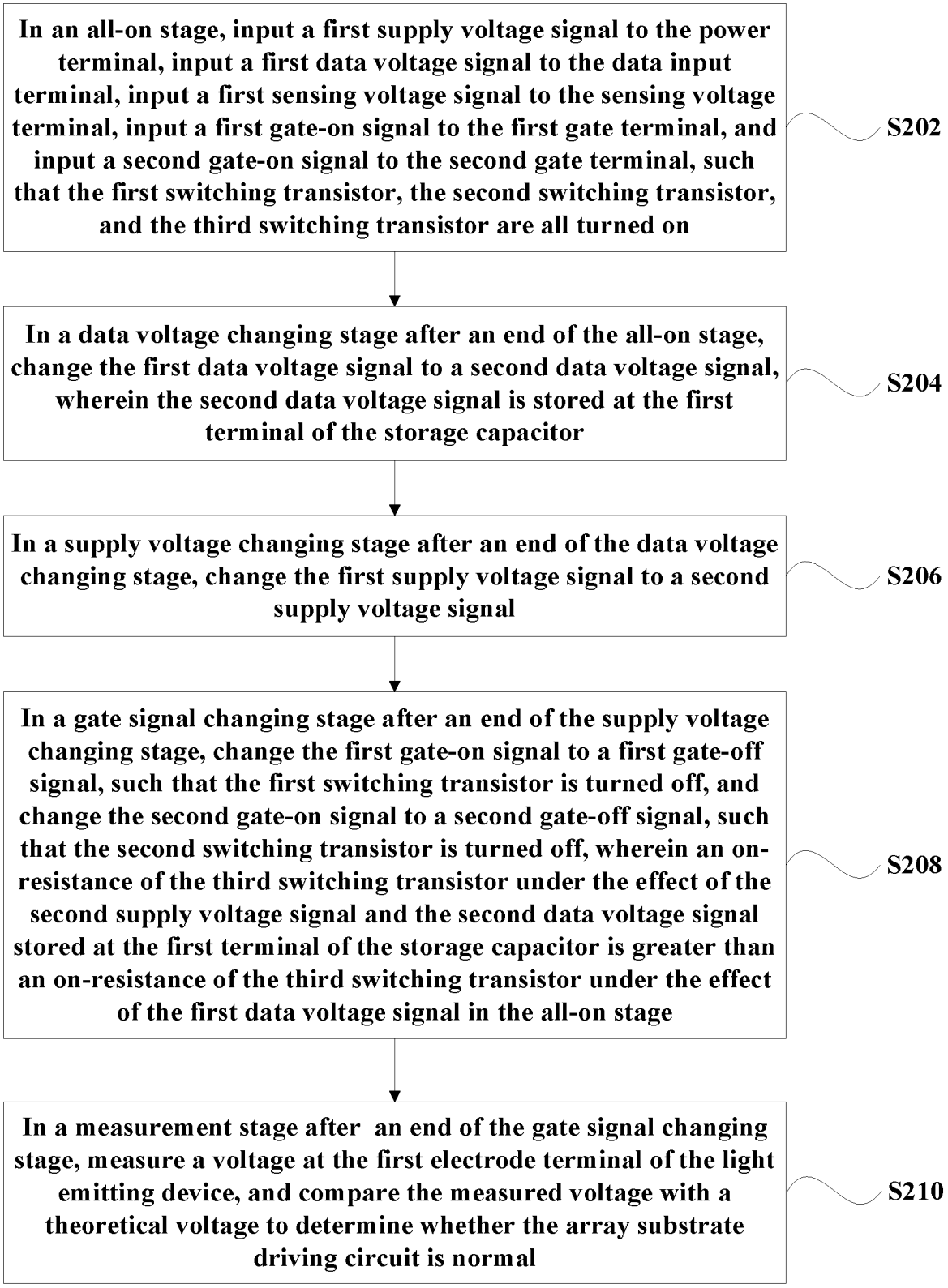
FIG. 2B is a flow chart showing a detection method for an array substrate driving circuit according to another embodiment of the present disclosure.
Figure 3:
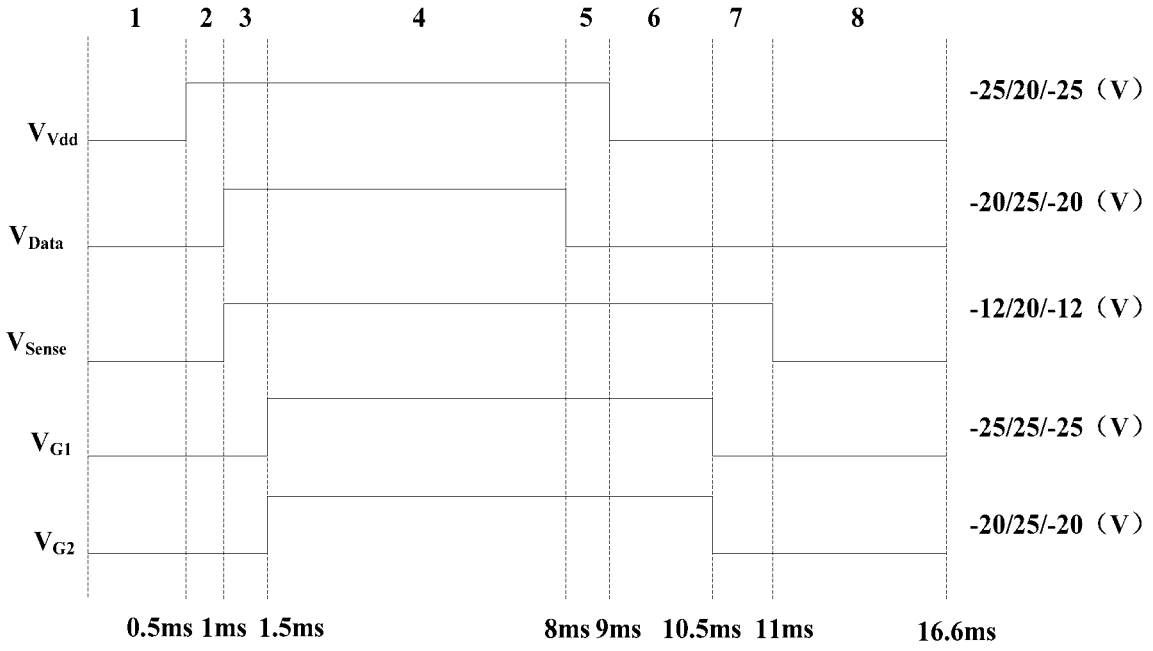
FIG. 3 is a timing diagram schematically showing a detection method for an array substrate driving circuit according to an embodiment of the present disclosure.

FIG. 2B is a flow chart showing a detection method for an array substrate driving circuit according to another embodiment of the present disclosure. FIG. 3 is a timing diagram schematically showing a detection method for an array substrate driving circuit according to an embodiment of the present disclosure. Hereinafter, taking the first switching transistor T1, the second switching transistor T2, and the third switching transistor T3 which are all NMOS transistors as an example, and in conjunction with FIG. 2B and FIG. 3, a detection method for an array substrate driving circuit according to some embodiments of the present disclosure will be described in detail.

As shown in FIG. 2B, at step S202, in an all-on stage, a first supply voltage signal is input to the power terminal, a first data voltage signal is input to the data input terminal, a first sensing voltage signal is input to the sensing voltage terminal, a first gate-on signal is input to the first gate terminal, and a second gate-on signal is input to the second gate terminal, such that the first switching transistor, the second switching transistor, and the third switching transistor are all turned on.

For example, the all-on stage may refer to the fourth stage in the timing diagram shown in FIG. 3. As shown in FIG. 3, a supply voltage signal $V_{Vdd}$ is input to the power terminal Vdd, a data voltage signal $V_{Data}$ is input to the data input terminal Da, a sensing voltage signal $V_{Sense}$ is input to the sensing voltage terminal Sen, a first gate voltage signal $V_{G1}$ is input to the first gate terminal G1, and a second gate voltage signal $V_{G2}$ is input to the second gate terminal G2. In the fourth stage, the levels of the supply voltage signal $V_{Vdd}$, the data voltage signal $V_{Data}$, the sensing voltage signal $V_{Sense}$, the first gate voltage signal $V_{G1}$, and the second gate voltage signal $V_{G2}$ are respectively high levels (i.e., levels higher than 0V) of the first supply voltage signal, the first data voltage signal, the first sensing voltage signal, the first gate-on signal, and the second gate-on signal.

In this embodiment, in a case where the first switching transistor T1, the second switching transistor T2, and the third switching transistor T3 are all NMOS transistors, all of the first supply voltage signal, the first data voltage signal, the first sensing voltage signal, the first gate-on signal and the second gate-on signal may have a level higher than 0V. It should be noted that, although these signals all have a level higher than 0V, it does not mean that the levels of these signals have to be equal. The levels of these signals may or may not be equal. For example, as shown in FIG. 3, both of the first supply voltage signal $V_{Vdd}$ and the first sensing voltage signal $V_{Sense}$ may be 20V, while all of the first data voltage signal $V_{Data}$, the first gate-on signal $V_{G1}$, and the second gate-on signal $V_{G2}$ may be 25V.

In the all-on stage (the fourth stage), as shown in FIGS. 1 and 3, the first gate-on signal having a high level is input to the first gate terminal G1, and the second gate-on signal having a high level is input to the second gate terminal G2, so that the first switching transistor T1 and the second switching transistor T2 are turned on. Moreover, the first data voltage signal having a high level is input to the data input terminal Da, so that a level of the node G3 is raised. The first data voltage signal $V_{Data}$ is applied to the gate 130 of the third switching transistor T3 via the first switching transistor T1. For example, the first data voltage signal $V_{Data}$ may be 25V. Moreover, the first electrode 131 of the third switching transistor T3 is electrically connected to the first electrode terminal ITO, and at this time, the level of the first electrode 131 is a low level (for example, a level lower than 0V). Thus, in the all-on stage, the voltage difference between the gate and the first electrode of the third switching transistor T3 is at least 25V, so that the third switching transistor T3 is in a completely-on saturated state. That is, the third switching transistor T3 is in a completely-on state.

In the all-on stage, since the second switching transistor T2 and the third switching transistor T3 are both turned on, the first supply voltage signal $V_{Vdd}$ and the first sensing voltage signal $V_{Sense}$ having high levels are both applied to the first electrode terminal ITO of the light emitting device, which results in that the level $V_{oled}$ of the first electrode terminal ITO is a high level. For example, the first supply voltage signal $V_{Vdd}$ is 20V, the first sensing voltage signal $V_{Sense}$ is 20V, and the level on the line from the power terminal Vdd to the sensing voltage terminal Sen is substantially 20V, so that $V_{oled}$ is about 20V at this time.

Returning to FIG. 2B, at step S204, in a data voltage changing stage after an end of the all-on stage, the first data voltage signal is changed to a second data voltage signal, wherein the second data voltage signal is stored at the first terminal of the storage capacitor.

For example, the data voltage changing stage may refer to the fifth stage in the timing diagram shown in FIG. 3. As shown in FIG. 3, in the fifth stage, for the data voltage signal $V_{Data}$, the first data voltage signal having a high level is changed to the second data voltage signal having a low level. In this embodiment, the second data voltage signal may be a level lower than 0V. For example, the level of the second data voltage signal may be −20V. As shown in FIG. 3, in the fifth stage, except for the data voltage signal $V_{Data}$, other voltage signals are substantially unchanged.

In the data voltage changing stage (the fifth stage), as shown in FIGS. 1 and 3, under the effect of the first gate-on signal, the first switching transistor T1 is turned on. Since the first data voltage signal having a high level is changed to the second data voltage signal having a low level, the level of the node G3 is lowered, which results in that the third switching transistor T3 is turned off. However, under the effect of the second gate-on signal, the second switching transistor T2 is turned on, so that the sensing voltage signal $V_{Sense}$ having a high level is applied to the first electrode terminal ITO via the second switching transistor T2. Therefore, the voltage $V_{oled}$ of the first electrode terminal ITO is unchanged. In this stage, the second data voltage signal $V_{Data}$ is stored at the first terminal 101 of the storage capacitor Cst.

Returning to FIG. 2B, at step S206, in a supply voltage changing stage after an end of the data voltage changing stage, the first supply voltage signal is changed to a second supply voltage signal.

For example, the supply voltage changing stage may refer to the sixth stage in the timing diagram shown in FIG. 3. As shown in FIG. 3, in the sixth stage, for the supply voltage signal $V_{Vdd}$, the first supply voltage signal having a high level is changed to the second supply voltage signal having a low level. In this embodiment, the second supply voltage signal may be a level lower than 0V. For example, the level of the second supply voltage signal may be −25V. As shown in FIG. 3, in the sixth stage, except for the supply voltage signal $V_{Vdd}$, other voltage signals are substantially unchanged.

In some embodiments, as shown in FIG. 3, the level of the second data voltage signal $V_{Data}$ is higher than the level of the second supply voltage signal $V_{Vdd}$. In some embodiments, a difference $V_{Data_Vdd}$ between the level of the second data voltage signal $V_{Data}$ and the level of the second supply voltage signal $V_{Vdd}$ may be in a range of $0V<V_{Data_Vdd}\leq 5V$. For example, as shown in FIG. 3, the level of the second data voltage signal $V_{Data}$ may be −20V, and the level of the second supply voltage signal $V_{Vdd}$ may be −25V, so that there is a difference of 5V therebetween.

In the supply voltage changing stage (the sixth stage), as shown in FIGS. 1 and 3, under the effect of the first gate-on signal, the first switching transistor T1 is turned on. The data voltage signal $V_{Data}$ is the second data voltage signal having a low level, and the supply voltage signal $V_{Vdd}$ is the second supply voltage signal having a low level. However, the level of the second data voltage signal is higher than that of the second supply voltage signal (for example, the difference therebetween is substantially greater than a threshold voltage of the third switching transistor), which results in that the third switching transistor T3 is an incompletely-on state.

Here, the "incompletely-on state" means that the third switching transistor is turned on but with an on-resistance which is greater than the on-resistance of the third switching transistor in the completely-on state. In the supply voltage changing stage, the second data voltage signal $V_{Data}$ is applied to the gate of the third switching transistor T3. For example, the second data voltage signal $V_{Data}$ may be −20V. Moreover, the second supply voltage signal $V_{Vdd}$ is applied to the second electrode 132 of the third switching transistor T3. For example, the second supply voltage signal $V_{Vdd}$ may be −25V. Thus, in the supply voltage changing stage, there is a voltage difference of 5V between the gate and the second electrode of the third switching transistor T3. It is apparent that the voltage difference between the gate and the second electrode of the third switching transistor T3 in the supply voltage changing stage is less than the voltage difference between the gate and the first electrode of the third switching transistor in the all-on stage. The third switching transistor in the supply voltage changing stage is in the incompletely-on state, with its on-resistance which is greater than the on-resistance of the third switching transistor in the all-on stage. In the previous all-on stage, the third switching transistor is in the completely-on state.

Figure 4:
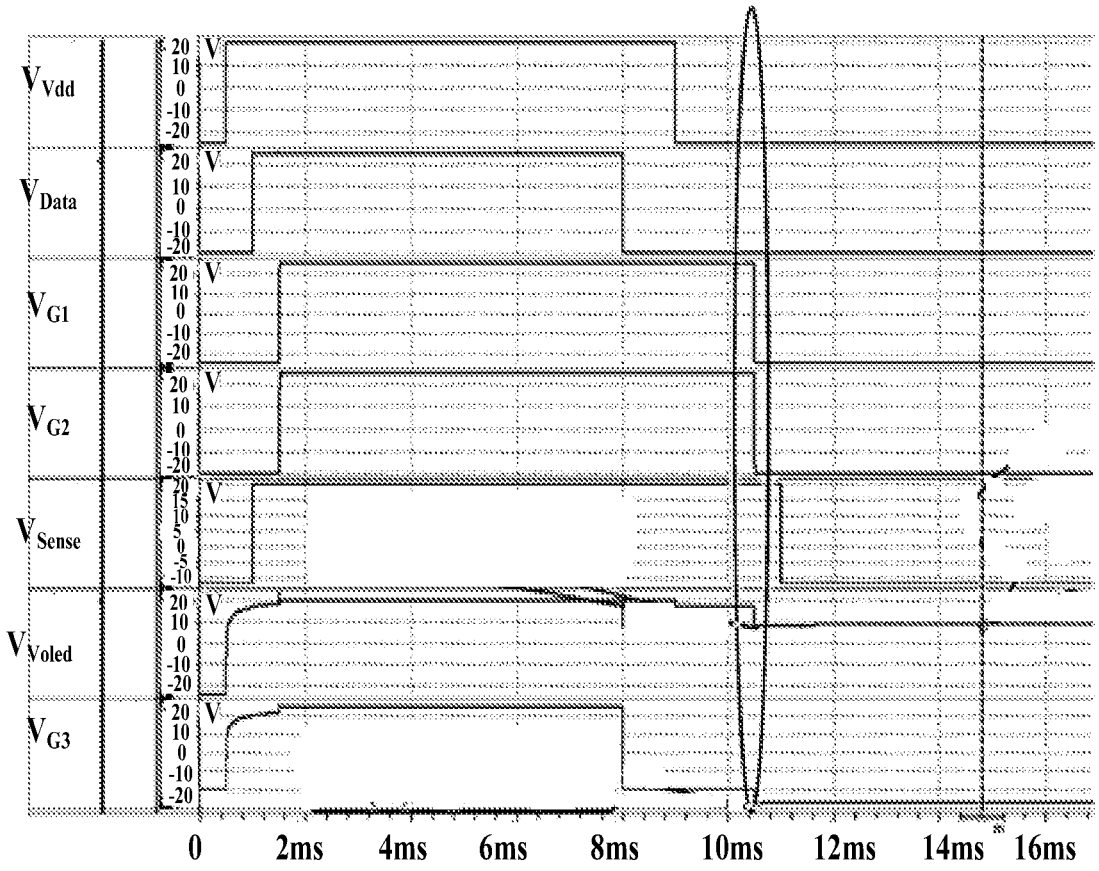
FIG. 4 is a simulation result diagram schematically showing a detection method for an array substrate driving circuit according to an embodiment of the present disclosure.

In the supply voltage changing stage, as shown in FIGS. 1 and 3, under the effect of the second gate-on signal, the second switching transistor T2 is turned on. Thus, the level of the first electrode terminal ITO of the light emitting device will be affected by the first sensing voltage signal $V_{Sense}$ having a high level and the second supply voltage signal $V_{Vdd}$ having a low level. Since the third switching transistor T3 is in the incompletely-on state with its on-resistance which is greater than the on-resistance of the second switching transistor, the influence of the second supply voltage signal $V_{Vdd}$ on the level of the first electrode terminal ITO is less than the influence of the first sensing voltage signal $V_{Sense}$ on the level of the first electrode terminal ITO. This results in that the level of the first electrode terminal ITO is lowered slightly, but is still a high level. For example, as shown in FIG. 4, from the simulation result, in the supply voltage changing stage, the level of the first electrode terminal ITO is about 18V, which is slightly lower than the former 20V.

Returning to FIG. 2B, at step S208, in a gate signal changing stage after an end of the supply voltage changing stage, the first gate-on signal is changed to a first gate-off signal, such that the first switching transistor is turned off, and the second gate-on signal is changed to a second gate-off signal, such that the second switching transistor is turned off, wherein an on-resistance of the third switching transistor under an effect of the second supply voltage signal and the second data voltage signal stored at the first terminal of the storage capacitor is greater than an on-resistance of the third switching transistor under an effect of the first data voltage signal in the all-on stage.

For example, the gate signal changing stage may refer to the seventh stage in the timing diagram shown in FIG. 3. As shown in FIG. 3, in the seventh stage, for the first gate voltage signal $V_{G1}$, the first gate-on signal having a high level is changed to the first gate-off signal having a low level; for the second gate voltage signal $V_{G2}$, the second gate-on signal having a high level is changed to the second gate-off signal having a low level. In this embodiment, both of the first gate-off signal and the second gate-off signal may be a level lower than 0V. For example, the level of the first gate-off signal may be −25V, and the level of the second gate-off signal may be −20V.

In the gate signal changing stage (the stage 7), as shown in FIGS. 1 and 3, the sensing voltage signal input to the sensing voltage terminal is still the first sensing voltage signal $V_{Sense}$ having a high level. The first gate-off signal having a low level is input to the first gate terminal G1, such that the first switching transistor T1 is turned off. The second gate-off signal having a low level is input to the second gate terminal G2, such that the second switching transistor T2 is turned off. At this time, the second data voltage signal $V_{Data}$ (for example, −20V) stored at the first terminal 101 of the storage capacitor Cst is applied to the gate 130 of the third switching transistor T3. The second supply voltage signal $V_{Vdd}$ is applied to the second electrode (e.g., the drain) 132 of the third switching transistor T3. Moreover, the high level (about 18 V) of the first electrode terminal ITO causes the first electrode 131 of the third switching transistor T3 to be at a high level. In this way, the third switching transistor is in the incompletely-on state under the effect of the second supply voltage signal $V_{Vdd}$ and the second data voltage signal $V_{Data}$ stored at the first terminal of the storage capacitor, and its on-resistance is greater than the on-resistance of the third switching transistor under the effect of the first data voltage signal $V_{Data}$ (i.e., the on-resistance of the third switching transistor in the completely-on state). In such case, the voltage $V_{oled}$ at the first electrode terminal ITO of the light emitting device is lowered, which results in that the level of the node G3 is also lowered, so that the third switching transistor T3 is turned off. Finally, it results in that the voltage $V_{oled}$ at the first electrode terminal ITO is further lowered on the basis of the supply voltage changing stage. For example, in the gate signal changing stage, the voltage $V_{oled}$ at the first electrode terminal ITO is lower than 20V, but is still a high level.

Returning to FIG. 2B, at step S210, in a measurement stage after an end of the gate signal changing stage, the voltage at the first electrode terminal of the light emitting device is measured, and the measured voltage is compared with a theoretical voltage to determine whether the array substrate driving circuit is normal.

In some embodiments, within the measurement stage, before measuring the voltage at the first electrode terminal of the light emitting device, the detection method may further comprise: changing the first sensing voltage signal to a second sensing voltage signal. For example, in a case where the first switching transistor T1, the second switching transistor T2, and the third switching transistor T3 are all NMOS transistors, the second sensing voltage signal $V_{Sense}$ may be a level lower than 0V. For example, as shown in FIG. 3, the level of the second sensing voltage signal may be −12V.

In some embodiments, the array substrate driving circuit is determined to be normal (for example, the pixel driving circuit is determined to be normal) in a case where a difference between the measured voltage and the theoretical voltage is within a predetermined range. The array substrate driving circuit is determined to be abnormal (for example, the pixel driving circuit is determined to be abnormal) in a case where the difference between the measured voltage and the theoretical voltage is out of the predetermined range.

Here, the theoretical voltage may be a simulation voltage at the first electrode terminal of the light emitting device in a case where the array substrate driving circuit is normal. FIG. 4 is a simulation result diagram schematically showing a detection method for an array substrate driving circuit according to an embodiment of the present disclosure. As can be seen from FIG. 4, the theoretical voltage at the first electrode terminal of the light emitting device obtained by simulation may be 8V.

In the process of determining whether the array substrate driving circuit is normal, it is possible to determine whether the difference between the measured voltage at the first electrode terminal ITO and the theoretical voltage (for example, 8 V) is within the predetermined range (for example, the predetermined range may be $[-10\%*V_{theoretical}, 10\%*V_{theoretical}]$, where $V_{theoretical}$ represents the theoretical voltage). If the difference is within the predetermined range, the array substrate driving circuit is determined to be normal (for example, the pixel driving circuit is determined to be normal), otherwise the array substrate driving circuit is determined to be abnormal (for example, the pixel driving circuit is determined to be abnormal). Of course, those skilled in the art can understand that, the predetermined range of the embodiments of the present disclosure may be determined according to actual conditions, and is not only limited to the embodiments disclosed here.

Hitherto, a detection method according to other embodiments of the present disclosure is provided. In the detection method, in the all-on stage, the first supply voltage signal is input to the power terminal, the first data voltage signal is input to the data input terminal, the first sensing voltage signal is input to the sensing voltage terminal, the first gate-on signal is input to the first gate terminal, and the second gate-on signal is input to the second gate terminal, such that the first switching transistor, the second switching transistor, and the third switching transistor are all turned on. Next, in the data voltage changing stage, the first data voltage signal is changed to the second data voltage signal. Next, in the supply voltage changing stage, the first supply voltage signal is changed to the second supply voltage signal. Next, in the gate signal changing stage, the first gate-on signal is changed to the first gate-off signal, and the second gate-on signal is changed to the second gate-off signal. Next, in the measurement stage, the voltage at the first electrode terminal of the light emitting device is measured, and the measured voltage is compared with the theoretical voltage to determine whether the array substrate driving circuit is normal, so that the detection of the array substrate driving circuit is realized. The detection of the pixel driving circuit comprised in the array substrate driving circuit may also be realized by the above-described detection method.

In some embodiments of the present disclosure, a line connected to the power terminal Vdd is referred to as a power supply line $L_{Vdd}$, a line connected to the data input terminal Da is referred to as a data line $L_{Data}$, a line connected to the sensing voltage terminal Sen is referred to as a sensing signal line $L_{Sense}$, a line connected to the first gate terminal G1 is referred to as a first gate line $L_{G1}$, a line connected to the second gate terminal G2 is referred to as a second gate line $L_{G2}$, and a line connected to the first electrode terminal ITO of the light emitting device is referred to as a first electrode line $L_{ITO}$.

A problem that the array substrate driving circuit is abnormal resulting from at least one of the following short-circuit or open-circuit defects of these lines as described above may be detected by the detection method according to some embodiments of the present disclosure. For example, there are open-circuit problems respectively produced by $L_{Vdd}$, $L_{Data}$, $L_{Sense}$, $L_{G2}$, or $L_{ITO}$. Also for example, there are short-circuit problems of between $L_{Data}$ and $L_{Vdd}$, $L_{G1}$, $L_{G2}$, $L_{Sense}$ or $L_{ITO}$, short-circuit problems between $L_{G1}$ and $L_{Sense}$ or $L_{ITO}$, short-circuit problems between $L_{Vdd}$ and $L_{G2}$, $L_{Sense}$ or $L_{ITO}$, short-circuit problems between $L_{G2}$ and $L_{Sense}$ or $L_{ITO}$, or a short-circuit problem between $L_{Sense}$ and $L_{ITO}$. Those skilled in the art can understand that, The problem that the array substrate driving circuit is abnormal (for example, the pixel driving circuit is abnormal) resulting from other short-circuits or open circuits, which are no longer exhaustive here, may also be detected by the detection method of the embodiments of the present disclosure. In a case where at least one of the above-described line problems occurs, the difference between the voltage at the first electrode terminal ITO of the light emitting device measured by the above-described detection method and the theoretical voltage is out of the predetermined range, so that it can be detected that the array substrate driving circuit is abnormal.

For example, if the power supply line $L_{Vdd}$ is open-circuited, the voltage at the first electrode terminal ITO of the light emitting device is not affected by the supply voltage signal. In the supply voltage changing stage, since the second switching transistor is turned on, the sensing voltage signal having a high level (for example, 20V) is applied to the first electrode terminal ITO. Since the voltage at the first electrode terminal ITO of the light emitting device is not affected by the supply voltage signal, after the supply voltage signal $V_{Vdd}$ is changed to a low level (for example, −25V), the voltage $V_{oled}$ at the first electrode terminal ITO may still be a voltage of about 20V. Finally, the voltage $V_{oled}$ at the first electrode terminal ITO measured in the measurement stage may also be 20V. The difference between the measured voltage and the theoretical voltage will be out of the predetermined range, so that it is detected that the array substrate driving circuit is abnormal.

For another example, the data line $L_{Data}$ is short-circuited with the power supply line $L_{Vdd}$, which will result in that the first terminal 101 of the storage capacitor Cst may store the first supply voltage signal having a high level (e.g., 20V), so that a voltage of 20V is applied to the gate of the third switching transistor, and a voltage of −25V is applied to the second electrode of the third switching transistor in the gate signal changing stage. This results in that the third switching transistor is in a completely-on state. Thus, the voltage at the first electrode terminal ITO measured in the measurement stage is substantially equal to the voltage of the supply voltage signal at this time. For example, the voltage at the first electrode terminal ITO may be −20V. It is apparent that the difference between the measured voltage and the theoretical voltage (for example, 8 V) is out of the predetermined range, so that it is detected that the array substrate driving circuit is abnormal.

A circuit abnormality caused by the above-described multiple line defect problems (for example, short-circuit or open-circuit problems of some of the above-described lines) may be detected by the above-described detection method of the embodiments of the present disclosure. Compared with the related methods known to the inventors which can only detect the circuit abnormality problem caused by one line defect, the detection method of the embodiments of the present disclosure apparently enhances the pixel detection capability, and thus also enhances the array detection capability. This may save the array detection time, improve the detection efficiency, raise equipment capacity, and save the cost of the back-end EL (Electro Luminescence) material.

In the above-described embodiments, by changing (e.g., lowering) the supply voltage signal $V_{Vdd}$, the data voltage signal $V_{Data}$, the first gate voltage signal $V_{G1}$ the second gate voltage signal $V_{G2}$, and the sensing voltage signal $V_{Sense}$ in a staged manner, it is possible to prevent the competition problems that these signals may have in the change process, which is favorable for the accuracy of the measurement results and the simulation results.

In some embodiments, before the all-on stage, the detection method may also comprise: as shown in FIG. 3, in an initial stage (for example, the first stage of the timing diagram shown in FIG. 3), inputting the second supply voltage signal to the power terminal Vdd, inputting the second data voltage signal to the data input terminal Da, inputting the second sensing voltage signal to the sensing voltage terminal Sen, inputting the first gate-off signal to the first gate terminal G1, and inputting to the second gate-off signal to the second gate terminal G2, such that the first switching transistor, the second switching transistor, and the third switching transistor are all turned off. In this embodiment, the above-described voltage signals having low levels are respectively input to the power terminal Vdd, the data input terminal Da, the sensing voltage terminal Sen, the first gate terminal G1 and the second gate terminal G2, so that it is possible to produce a resetting effect on the array substrate driving circuit.

In general, the array substrate driving circuit may comprise a plurality of pixel driving circuits as shown in FIG. 1. Moreover, among different pixel driving circuits, there may also be some capacitors (not shown in FIG. 1). By the above-described reset operation, these capacitors may be discharged, which is favorable for the voltage at the first electrode terminal ITO to be more accurately measured, so that it is more accurately determined that whether the pixel driving circuit is normal, and it is further determined that whether the array substrate driving circuit is normal.

In some embodiments, the detection method further comprises: in a second stage (e.g., the second stage of the timing diagram shown in FIG. 3) after an end of the initial stage, changing the second supply voltage signal to the first supply voltage signal. For example, as shown in FIG. 3, the supply voltage signal $V_{Vdd}$ is changed from the low level to the high level, which achieves the purpose of inputting the first supply voltage signal to the power terminal. In this second stage, the third switching transistor T3 is turned off, and the voltage at the first electrode terminal ITO is a low level.

In some embodiments, the detection method further comprises: in a third stage (for example the third stage of the timing diagram shown in FIG. 3) after an end of the second stage, changing the second data voltage signal to the first data voltage signal and changing the second sensing voltage signal to the first sensing voltage signal. For example, as shown in FIG. 3, the data voltage signal $V_{Data}$ is changed from the low level to the high level, and the sensing voltage signal $V_{Sense}$ is changed from the low level to the high level, which achieves the purpose of inputting the first data voltage signal to the data input terminal Da and inputting the first sensing voltage signal to the sensing voltage terminal Sen. In this third stage, the first switching transistor T1, the second switching transistor T2, and the third switching transistor T3 are all turned off, and the voltage at the first electrode terminal ITO is a low level.

In some embodiments, as shown in FIG. 3, the step of inputting the first gate-on signal and the second gate-on signal in the all-on stage comprises: changing the first gate-off signal to the first gate-on signal, and changing the second gate-off signal to the second gate-on signal. For example, in the fourth stage shown in FIG. 3, the first gate voltage signal $V_{G1}$ is changed from the low level to the high level, and the second gate voltage signal $V_{G2}$ is changed from the low level to the high level, thereby achieving the purpose of inputting the first gate-on signal to the first gate terminal and inputting the second gate-on signal to the second gate terminal.

In the foregoing description, the detection method is described by taking the first switching transistor, the second switching transistor, and the third switching transistor all as NMOS transistors as an example. In other embodiments, the first switching transistor, the second switching transistor, and the third switching transistor may also all be PMOS (P-channel Metal Oxide Semiconductor) transistors.

In other embodiments, in the case where the first switching transistor, the second switching transistor, and the third switching transistor are all PMOS transistors, all of the first supply voltage signal, the first data voltage signal, the first sensing voltage signal, the first gate-on signal, and the second gate-on signal may have a level lower than 0V; and all of the second data voltage signal, the second supply voltage signal, the first gate-off signal, and the second gate-off signal may have a level higher than 0V. Here, the level of the second data voltage signal is lower than the level of the second supply voltage signal. For example, in such case, a difference $V_{Data'_Vdd'}$ between the level of the second data voltage signal and the level of the second supply voltage signal may be in a range of $-5V \leq V_{Data'_Vdd'} < 0V$.

In other embodiments, the second sensing voltage signal may have a level higher than 0V in a case where the first switching transistor, the second switching transistor, and the third switching transistor are all PMOS transistors.

Figure 5:
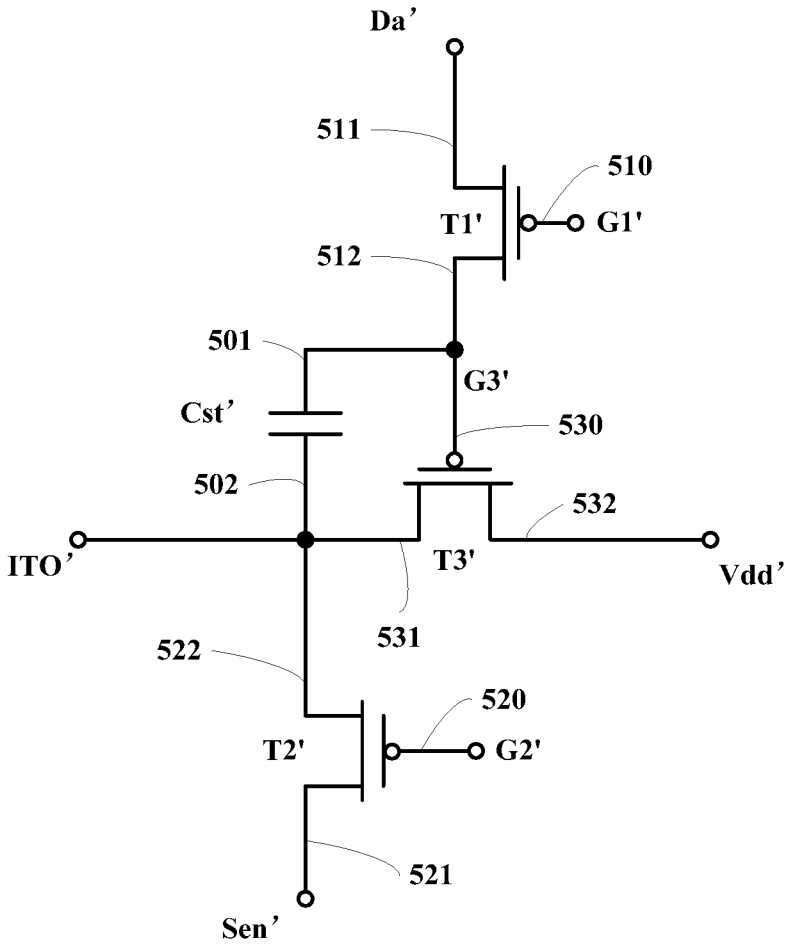
FIG. 5 is a circuit connection diagram schematically showing a pixel driving circuit of another embodiment.

FIG. 5 is a circuit connection diagram schematically showing a pixel driving circuit of another embodiment. The pixel driving circuit as shown in FIG. 5 is different from the pixel driving circuit as shown in FIG. 1 in that, the first switch transistor T1', the second switch transistor T2' and the third switch transistor T3' are all PMOS transistors. FIG. 5 shows the gate 510, the first electrode 511 and the second electrode 512 of the first switching transistor T1', the gate 520, the first electrode 521 and the second electrode 522 of the second switching transistor T2', and the gate 530, the first electrode 531 and the second electrode 532 of the third switching transistor T3'. FIG. 5 also shows the power terminal Vdd', the data input terminal Da', the sensing voltage terminal Sen', the first gate terminal G1', the second gate terminal G2', the node G3', the storage capacitor Cst' (comprising the first terminal 501 and the second terminal 502) and the first electrode terminal ITO' of the light emitting device. The circuit diagram shown in FIG. 5 is similar to the circuit diagram shown in FIG. 1. For the circuit connection relation in FIG. 5, reference may be made to the description of FIG. 1 which will not be repeated here. In some embodiments, the array substrate driving circuit comprises a plurality of pixel driving circuits as shown in FIG. 5.

Figure 6:
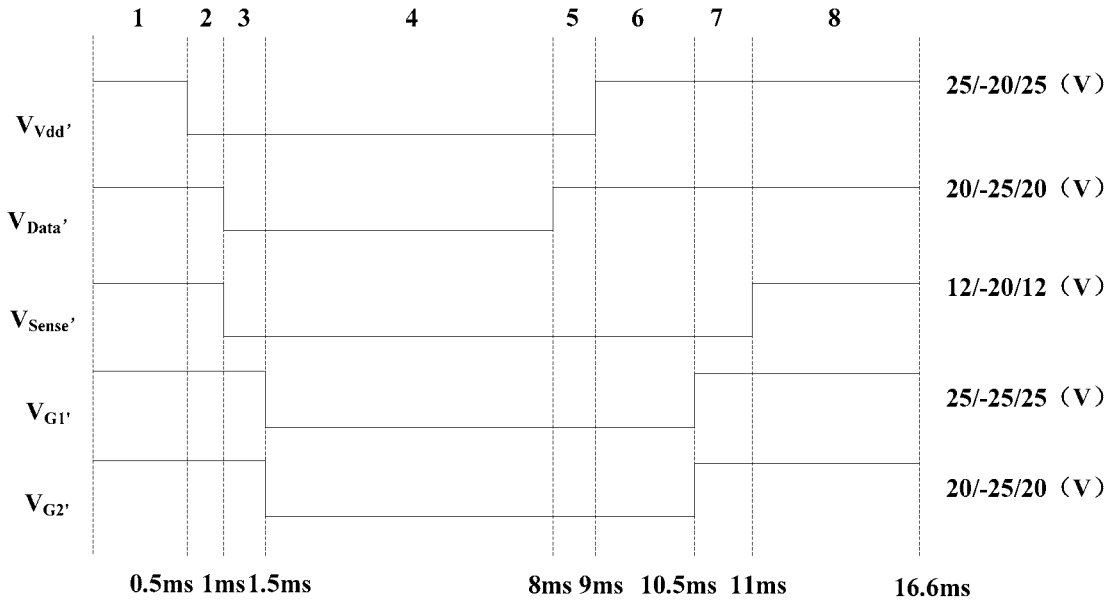
FIG. 6 is a timing diagram schematically showing a detection method for an array substrate driving circuit according to another embodiment of the present disclosure.

FIG. 6 is a timing diagram schematically showing a detection method for an array substrate driving circuit according to another embodiment of the present disclosure. Hereinafter, taking the first switching transistor, the second switching transistor, and the third switching transistor which are all PMOS transistors as an example, and in conjunction with FIG. 5 and FIG. 6, a detection method for an array substrate driving circuit according to other embodiments of the present disclosure will be described in detail.

As shown in FIG. 6, in the first stage (i.e. the initial stage), a supply voltage signal $V_{Vdd'}$ having a high level is input to the power terminal $V_{dd'}$, a data voltage signal $V_{Data'}$ having a high level is input to the data input terminal Da', a sensing voltage signal $V_{Sense'}$ having a high level is input to the sensing voltage terminal Sen', a first gate voltage signal $V_{G1'}$ having a high level is input to the first gate terminal G1', and a second gate voltage signal $V_{G2'}$ having a high level is input to the second gate terminal G2', such that the first switch transistor T1', the second switch transistor T2' and the third switch transistor T3' are all turned off. Here, the supply voltage signal $V_{Vdd'}$ having a high level may be used as a second supply voltage signal (for example, 25V), the data voltage signal $V_{Data'}$ having a high level may be used as a second data voltage signal (for example, 20V), the sensing voltage signal $V_{Sense'}$ having a high level may be used as a second sensing voltage signal (for example, 12V), the first gate voltage signal $V_{G1'}$ having a high level may be used as a first gate-off signal (for example, 25V), and the second gate voltage signal $V_{G2'}$ having a high level may be used as a second gate-off signal (for example, 20V).

Next, as shown in FIG. 6, in the second stage, the second supply voltage signal is changed to a first supply voltage signal having a low level (for example, −20V). That is, the supply voltage signal $V_{Vdd'}$ is changed from the high level to the low level, which achieves the purpose of inputting the first supply voltage signal to the power terminal.

Next, as shown in FIG. 6, in the third stage, the second data voltage signal is changed to a first data voltage signal having a low level (for example, −25V), and the second sensing voltage signal is changed to a first sensing voltage signal having a low level (for example, −20V). That is, the data voltage signal $V_{Data'}$ is changed from the high level to the low level, and the sensing voltage signal $V_{Sense'}$ is changed from the high level to the low level. This achieves the purpose of inputting the first data voltage signal to the data input terminal Da' and inputting the first sensing voltage signal to the sensing voltage terminal Sen'.

Next, as shown in FIG. 6, in the fourth stage (i.e., the all-on stage), the first gate-off signal is changed to the first gate-on signal having a low level (for example, −25V), and the second gate-off signal is changed to the second gate-on signal having a low level (for example, −25V). In this stage, the purpose that the first supply voltage signal is input to the power terminal, the first data voltage signal is input to the data input terminal, the first sensing voltage signal is input to the sensing voltage terminal, the first gate-on signal is input to the first gate terminal, and the second gate-on signal is input to the second gate terminal is achieved, such that the first switching transistor, the second switching transistor, and the third switching transistor are all turned on.

In the all-on stage (the fourth stage), as shown in FIGS. 5 and 6, the first gate-on signal having a low level is input to the first gate terminal G1', and the second gate-on signal having a low level is input to the second gate terminal G2', so that the first switching transistor T1' and the second switching transistor T2' are both turned on. Moreover, the first data voltage signal $V_{Data'}$ having a low level is input to the data input terminal Da', so that the level of the node G3' is lowered. The first data voltage signal $V_{Data'}$ is applied to the gate 530 of the third switching transistor T3' via the first switching transistor T1', so that the third switching transistor T3' is turned on (at this time, the third switching transistor T3' is in a completely-on state). Since the second switching transistor T2' and the third switching transistor T3' are both turned on, the first supply voltage signal $V_{Vdd'}$ and the first sensing voltage signal $V_{Sense'}$ having low levels are both applied to the first electrode terminal ITO' of the light emitting device, which results in that the level $V_{oled'}$ of the first electrode terminal ITO' is a low level. For example, $V_{oled'}$ may be −20V at this time.

Next, as shown in FIG. 6, in the fifth stage (i.e., the data voltage changing stage), the first data voltage signal having a low level is changed to the second data voltage signal having a high level (for example, 20V). The second data voltage signal $V_{Data'}$ is stored at the first terminal 501 of the storage capacitor Cst'.

In the data voltage changing stage (i.e., the fifth stage), as shown in FIGS. 5 and 6, under the effect of the first gate-on signal, the first switching transistor T1 is turned on. Since the first data voltage signal having a low level is changed to the second data voltage signal having a high level, the level of the node G3' is raised, which results in that the third switching transistor T3' is turned off. However, under the effect of the second gate-on signal, the second switching transistor T2' is turned on, so that the level $V_{oled'}$ of the first electrode terminal ITO' is unchanged.

Next, as shown in FIG. 6, in the sixth stage (i.e., the supply voltage changing stage), the first supply voltage signal having a low level is changed to the second supply voltage signal having a high level (for example, 25V).

In the supply voltage changing stage (the sixth stage), as shown in FIGS. 5 and 6, under the effect of the first gate-on signal, the first switching transistor T1' is turned on. Under the effect of the second gate-on signal, the second switching transistor T2' is turned on. The data voltage signal $V_{Data'}$ is the second data voltage signal having a high level, and the supply voltage signal $V_{Vdd'}$ is the second supply voltage signal having a high level. However, since the level of the second data voltage signal (for example, −25 V) is lower than the level of the second supply voltage signal (for example, −20V), the third switching transistor T3' is in an incompletely-on state, with its on-resistance which is greater than the on-resistance of the second switching transistor. Thus, the influence of the second supply voltage signal on the level of the first electrode terminal ITO' is less than the influence of the first sensing voltage signal on the level of the first electrode terminal ITO'. This results in that the level at the first electrode terminal ITO' is raised slightly, but is still a low level.

Next, as shown in FIG. 6, in the seventh stage (i.e., the gate signal changing stage), for the first gate voltage signal $V_{G1'}$, the first gate-on signal having a low level is changed to the first gate-off signal having a high level (e.g., 25V), so that the first switching transistor T1' is turned off. For the second gate voltage signal $V_{G2'}$, the second gate-on signal having a low level is changed to the second gate-off signal having a high level (e.g., 20V), so that the second switching transistor T2' is turned off. The third switching transistor T3' is in the incompletely-on state under the effect of the second supply voltage signal $V_{Vdd'}$ and the second data voltage signal $V_{Data'}$ stored at the first terminal 501 of the storage capacitor Cst', with its on-resistance which is greater than the on-resistance of the third switching transistor in the completely-on state. In such case, the voltage $V_{oled'}$ at the first electrode terminal ITO' of the light emitting device is raised, which results in that the level of the node G3' is also raised, so that the third switching transistor T3' is turned off. Finally, it results in that the voltage $V_{oled'}$ at the first electrode terminal ITO' is further raised on the basis of the supply voltage changing stage. For example, in the gate signal changing stage, the voltage $V_{oled'}$ at the first electrode terminal ITO' is higher than −20V, but is still a low level.

Next, as shown in FIG. 6, in the eighth stage (i.e., the measurement stage), the first sensing voltage signal having a low level is changed to the second sensing voltage signal having a high level (for example, 12V). Then, the voltage at the first electrode terminal of the light emitting device is measured, and the measured voltage is compared with a theoretical voltage (for example, −8V) to determine whether the array substrate driving circuit is normal. In a case where a difference between the measured voltage and the theoretical voltage is within a predetermined range, the array substrate driving circuit is determined to be normal (e.g., the pixel driving circuit is determined to be normal). In a case where the difference between the measured voltage and the theoretical voltage is out of the predetermined range, the array substrate driving circuit is determined to be abnormal (for example, the pixel driving circuit is determined to be abnormal).

Hitherto, a detection method for an array substrate driving circuit according to other embodiments of the present disclosure is provided. The above-described method is implemented in a case where the first switching transistor, the second switching transistor, and the third switching transistor are all PMOS transistors. By the above-described method, it is possible to effectuate detecting whether the array substrate driving circuit is normal, and it is also possible to effectuate detecting whether the pixel driving circuit is normal.

It should be noted that, although in the above description, the method described in the timing diagram of FIG. 6 comprises eight stages, wherein, the method starts from the first stage and ends in the eighth stage. However, those skilled in the art will appreciate that, similar to the foregoing, the above-described method may also start directly from the fourth stage. That is, the above-described method may also start directly from the all-on stage. In the all-on stage, the first supply voltage signal, the first data voltage signal, the first sensing voltage signal, the first gate-on signal, and the second gate-on signal are respectively input to the power terminal, the data input terminal, the sensing voltage terminal, the first gate terminal, and the second gate terminal. In this way, in the measurement stage (i.e., the eighth stage), it is also possible to effectuate detecting whether the array substrate driving circuit is normal.

In some embodiments of the present disclosure, in these above-described stages, the duration of the all-on stage is the longest. For example, as shown in FIG. 3 or FIG. 5, the duration of the all-on stage is 6.5 ms. In a case where the duration of the all-on stage is set to be relatively long, these signals such as the first supply voltage signal, the first data voltage signal, the first sensing voltage signal, the first gate-on signal, and the second gate-on signal may be made more stable, which is favorable for reducing the influence of inaccurate measurement results resulting from instability of a certain voltage signal.

In the method of the embodiments of the present disclosure, in a case where the supply voltage signal, the data voltage signal, the sensing voltage signal, the first gate voltage signal and the second gate voltage signal are respectively input to the power terminal, the data input terminal, the sensing voltage terminal, the first gate terminal, and the second gate terminal, with timing changes made to these voltage signals, the voltage at the first electrode terminal of the light emitting device is finally measured, and the measured voltage is compared with the theoretical voltage to determine whether the array substrate driving circuit is normal. The embodiments of the present disclosure effectuate detecting whether the array substrate driving circuit is normal. The detection method of the embodiments of the present disclosure may save the detection time, improve the detection efficiency, and raise equipment capacity.

Figure 7:
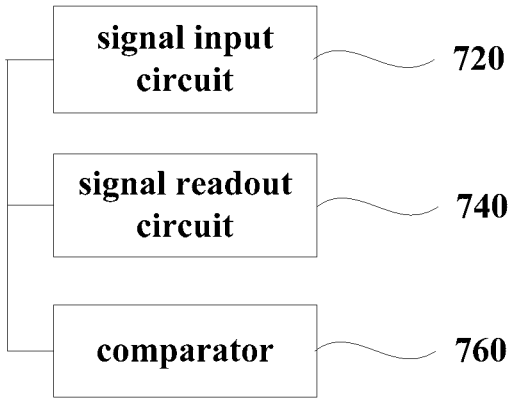
FIG. 7 is a structural diagram schematically showing a detection device for an array substrate driving circuit according to an embodiment of the present disclosure.

FIG. 7 is a structural diagram schematically showing a detection device for an array substrate driving circuit according to an embodiment of the present disclosure. The array substrate driving circuit may comprise the pixel driving circuit as described above (for example, the pixel driving circuit shown in FIG. 1 or FIG. 5). As shown in FIG. 7, the detection device may comprise a signal input circuit 720, a signal readout circuit 740, and a comparator 760.

The signal input circuit 720 is configured to, in an all-on stage, input a first supply voltage signal to the power terminal, input a first data voltage signal to the data input terminal, input a first sensing voltage signal to the sensing voltage terminal, input a first gate-on signal to the first gate terminal, and input a second gate-on signal to the second gate terminal, such that the first switching transistor, the second switching transistor, and the third switching transistor are all turned on; and change the first data voltage signal to a second data voltage signal in a data voltage changing stage after an end of the all-on stage, wherein the second data voltage signal is stored at the first terminal of the storage capacitor.

The signal readout circuit 740 is configured to read a voltage at the first electrode terminal of the light emitting device in a measurement stage after the data voltage changing stage.

The comparator 760 is configured to compare the read voltage with a theoretical voltage to determine whether the array substrate driving circuit is normal.

Hitherto, a detection device according to some embodiments of the present disclosure is provided. In the detection device, the signal input circuit inputs the first supply voltage signal to the power terminal, inputs the first data voltage signal to the data input terminal, inputs the first sensing voltage signal to the sensing voltage terminal, inputs the first gate-on signal to the first gate terminal, and inputs the second gate-on signal to the second gate terminal, such that the first switching transistor, the second switching transistor, and the third switching transistor are all turned on in the all-on stage; and changes the first data voltage signal to the second data voltage signal in the data voltage changing stage. The signal readout circuit reads the voltage at the first electrode terminal of the light emitting device in the measurement stage. The comparator compares the read voltage with a theoretical voltage to determine whether the array substrate driving circuit is normal. Thereby, the detection of the array substrate driving circuit is realized. For example, the detection of a data line for transmitting the data voltage signal may be realized by the above-described detection device.

In some embodiments, the comparator 760 is configured to determine the array substrate driving circuit to be normal in a case where a difference between the read voltage and the theoretical voltage is within a predetermined range; and determine the array substrate driving circuit to be abnormal in the case where the difference between the read voltage and the theoretical voltage is out of the predetermined range.

In some embodiments, the signal input circuit 720 is further configured to change the first supply voltage signal to a second supply voltage signal in a supply voltage changing stage after an end of the data voltage changing stage and before the measurement stage.

In some embodiments, the signal input circuit 720 is further configured to, in a gate signal changing stage after an end of the supply voltage changing stage and before the measurement stage, change the first gate-on signal to a first gate-off signal such that the first switching transistor is turned off, and change the second gate-on signal to a second gate-off signal such that the second switching transistor is turned off, wherein an on-resistance of the third switching transistor under an effect of the second supply voltage signal and the second data voltage signal stored at the first terminal of the storage capacitor is greater than an on-resistance of the third switching transistor under an effect of the first data voltage signal in the all-on stage.

In some embodiments, the signal input circuit 720 is further configured to change the first sensing voltage signal to a second sensing voltage signal within the measurement stage. The second sensing voltage signal has a level lower than 0V in a case where the first switching transistor, the second switching transistor, and the third switching transistor are all NMOS transistors. The second sensing voltage signal has a level higher than 0V in a case where the first switching transistor, the second switching transistor, and the third switching transistor are all PMOS transistors.

In some embodiments, the signal input circuit 720 is further configured to, in an initial stage before the all-on stage, input the second supply voltage signal to the power terminal, input the second data voltage signal to the data input terminal, input the second sensing voltage signal to the sensing voltage terminal, input the first gate-off signal to the first gate terminal, and input the second gate-off signal to the second gate terminal, such that the first switching transistor, the second switching transistor, and the third switching transistor are all turned off.

In some embodiments, the signal input circuit 720 is further configured to change the second supply voltage signal to the first supply voltage signal in a second stage after an end of the initial stage and before the all-on stage.

In some embodiments, the signal input circuit 720 is further configured to, in a third stage after an end of the second stage and before the all-on stage, change the second data voltage signal to the first data voltage signal and change the second sensing voltage signal to the first sensing voltage signal.

In some embodiments, the signal input circuit 720 is further configured to, in the all-on stage, change the first gate-off signal to the first gate-on signal and change the second gate-off signal to the second gate-on signal.

Hereto, various embodiments of the present disclosure have been described in detail. Some details well known in the art are not described to avoid obscuring the concept of the present disclosure. According to the above description, those skilled in the art would fully know how to implement the technical solutions disclosed herein.

Although some specific embodiments of the present disclosure have been described in detail by way of examples, those skilled in the art should understand that the above examples are only for the purpose of illustration and are not intended to limit the scope of the present disclosure. It should be understood by those skilled in the art that modifications to the above embodiments and equivalently substitution of part of the technical features can be made without departing from the scope and spirit of the present disclosure. The scope of the disclosure is defined by the following claims.

What is claimed is:

1. A detection method for an array substrate driving circuit, wherein the array substrate driving circuit comprises a pixel driving circuit comprising a storage capacitor, a first switching transistor, a second switching transistor, and a third switching transistor, wherein a gate of the first switching transistor is electrically connected to a first gate terminal, a first electrode of the first switching transistor is electrically connected to a data input terminal, a second electrode of the first switching transistor is electrically connected to a first terminal of the storage capacitor, a gate of the second switching transistor is electrically connected to a second gate terminal, a first electrode of the second switching transistor is electrically connected to a sensing voltage terminal, a second electrode of the second switching transistor is electrically connected to a second terminal of the storage capacitor, the second terminal of the storage capacitor is electrically connected to a first electrode terminal of a light emitting device, and a gate of the third switching transistor is electrically connected to the first terminal of the storage capacitor, a first electrode of the third switching transistor is electrically connected to the first electrode terminal of the light emitting device, and a second electrode of the third switching transistor is electrically connected to a power terminal;

the detection method comprising:

in an all-on stage, inputting a first supply voltage signal to the power terminal, inputting a first data voltage signal to the data input terminal, inputting a first sensing voltage signal to the sensing voltage terminal, inputting a first gate-on signal to the first gate terminal, and inputting a second gate-on signal to the second gate terminal, such that the first switching transistor, the second switching transistor, and the third switching transistor are all turned on;

in a data voltage changing stage after an end of the all-on stage, changing the first data voltage signal to a second data voltage signal, wherein the second data voltage signal is stored at the first terminal of the storage capacitor; and in a measurement stage after the data voltage changing stage, measuring a voltage at the first electrode terminal of the light emitting device, and comparing the measured voltage with a theoretical voltage to determine whether the array substrate driving circuit is normal.

2. The detection method according to claim 1, wherein the array substrate driving circuit is determined to be normal in a case where a difference between the measured voltage and the theoretical voltage is within a predetermined range; and the array substrate driving circuit is determined to be abnormal in a case where the difference between the measured voltage and the theoretical voltage is out of the predetermined range.

3. The detection method according to claim 1, wherein before the measurement stage, the detection method further comprises:

in a supply voltage changing stage after an end of the data voltage changing stage, changing the first supply voltage signal to a second supply voltage signal.

4. The detection method according to claim 3, wherein before the measurement stage, the detection method further comprises:

in a gate signal changing stage after an end of the supply voltage changing stage, changing the first gate-on signal to a first gate-off signal, such that the first switching transistor is turned off, and changing the second gate-on signal to a second gate-off signal, such that the second switching transistor is turned off, wherein an on-resistance of the third switching transistor under an effect of the second supply voltage signal and the second data voltage signal stored at the first terminal of the storage capacitor is greater than an on-resistance of the third switching transistor under an effect of the first data voltage signal in the all-on stage.

5. The detection method according to claim 4, wherein the first switching transistor, the second switching transistor, and the third switching transistor are all NMOS transistors;

wherein a level of the second data voltage signal is higher than a level of the second supply voltage signal.

6. The detection method according to claim 5, wherein a difference $V_{Data_Vdd}$ between the level of the second data voltage signal and the level of the second supply voltage signal is in a range of $0V<V_{Data_Vdd}\leq 5V$.

7. The detection method according to claim 5, wherein the first supply voltage signal, the first data voltage signal, the first sensing voltage signal, the first gate-on signal, and the second gate-on signal all have a level higher than 0V; and the second data voltage signal, the second supply voltage signal, the first gate-off signal, and the second gate-off signal all have a level lower than 0V.

8. The detection method according to claim 4, wherein the first switching transistor, the second switching transistor, and the third switching transistor are all PMOS transistors;

wherein a level of the second data voltage signal is lower than a level of the second supply voltage signal.

9. The detection method according to claim 8, wherein a difference $V_{Data'_Vdd'}$ between the level of the second data voltage signal and the level of the second supply voltage signal is in a range of $-5V\leq V_{Data'_Vdd'}<0V$.

10. The detection method according to claim 8, wherein the first supply voltage signal, the first data voltage signal, the first sensing voltage signal, the first gate-on signal, and the second gate-on signal all have a level lower than 0V; and the second data voltage signal, the second supply voltage signal, the first gate-off signal, and the second gate-off signal all have a level higher than 0V.

11. The detection method according to claim 8, wherein, within the measurement stage, before measuring the voltage at the first electrode terminal of the light emitting device, the detection method further comprises:

changing the first sensing voltage signal to a second sensing voltage signal;

wherein the second sensing voltage signal has a level higher than 0V.

12. The detection method according to claim 5, wherein, within the measurement stage, before measuring the voltage at the first electrode terminal of the light emitting device, the detection method further comprises:

changing the first sensing voltage signal to a second sensing voltage signal;

wherein the second sensing voltage signal has a level lower than 0V.

13. The detection method according to claim 12, wherein before the all-on stage, the detection method further comprises:

in an initial stage, inputting the second supply voltage signal to the power terminal, inputting the second data voltage signal to the data input terminal, inputting the second sensing voltage signal to the sensing voltage terminal, inputting the first gate-off signal to the first gate terminal, and inputting the second gate-off signal to the second gate terminal, such that the first switching transistor, the second switching transistor, and the third switching transistor are all turned off.

14. The detection method according to claim 13, wherein before the all-on stage, the detection method further comprises:

in a second stage after an end of the initial stage, changing the second supply voltage signal to the first supply voltage signal.

15. The detection method according to claim 14, wherein before the all-on stage, the detection method further comprises:

in a third stage after an end of the second stage, changing the second data voltage signal to the first data voltage signal and changing the second sensing voltage signal to the first sensing voltage signal.

16. The detection method according to claim 15, wherein the step of inputting the first gate-on signal and the second gate-on signal in the all-on state stage comprises:

changing the first gate-off signal to the first gate-on signal, and changing the second gate-off signal to the second gate-on signal.

17. A detection device for an array substrate driving circuit, wherein the array substrate driving circuit comprises a pixel driving circuit comprising a storage capacitor, a first switching transistor, a second switching transistor, and a third switching transistor, wherein a gate of the first switching transistor is electrically connected to a first gate terminal, a first electrode of the first switching transistor is electrically connected to a data input terminal, a second electrode of the first switching transistor is electrically connected to a first terminal of the storage capacitor, a gate of the second switching transistor is electrically connected to a second gate terminal, a first electrode of the second switching transistor is electrically connected to a sensing voltage terminal, a second electrode of the second switching transistor is electrically connected to a second terminal of the storage capacitor, the second terminal of the storage capacitor is electrically connected to a first electrode terminal of a light emitting device, and a gate of the third switching transistor is electrically connected to the first terminal of the storage capacitor, a first electrode of the third switching transistor is electrically connected to the first electrode terminal of the light emitting device, and a second electrode of the third switching transistor is electrically connected to a power terminal;

the detection device comprising:

a signal input circuit configured to, in an all-on stage, input a first supply voltage signal to the power terminal, input a first data voltage signal to the data input terminal, input a first sensing voltage signal to the sensing voltage terminal, input a first gate-on signal to the first gate terminal, and input a second gate-on signal to the second gate terminal, such that the first switching transistor, the second switching transistor, and the third switching transistor are all turned on; and change the first data voltage signal to a second data voltage signal in a data voltage changing stage after an end of the all-on stage, wherein the second data voltage signal is stored at the first terminal of the storage capacitor;

a signal readout circuit configured to read a voltage at the first electrode terminal of the light emitting device in a measurement stage after the data voltage changing stage; and a comparator configured to compare the read voltage with a theoretical voltage to determine whether the array substrate driving circuit is normal.

18. The detection device according to claim 17, wherein the comparator is configured to determine the array substrate driving circuit to be normal in a case where a difference between the read voltage and the theoretical voltage is within a predetermined range; and determine the array substrate driving circuit to be abnormal in the case that the difference between the read voltage and the theoretical voltage is out of the predetermined range.

19. The detection device according to claim 17, wherein the signal input circuit is further configured to change the first supply voltage signal to a second supply voltage signal in a supply voltage changing stage after an end of the data voltage changing stage and before the measurement stage.

20. The detection device according to claim 19, wherein the signal input circuit is further configured to, in a gate signal changing stage after an end of the supply voltage changing stage and before the measurement stage, change the first gate-on signal to a first gate-off signal such that the first switching transistor is turned off, and change the second gate-on signal to a second gate-off signal such that the second switching transistor is turned off, wherein an on-resistance of the third switching transistor under an effect of the second supply voltage signal and the second data voltage signal stored at the first terminal of the storage capacitor is greater than an on-resistance of the third switching transistor under an effect of the first data voltage signal in the all-on stage.

* * * * *